United States Patent [19]

Nelson et al.

[11] Patent Number: 4,723,059

[45] Date of Patent: Feb. 2, 1988

[54] TACHOMETER SWITCH

[75] Inventors: Steve D. Nelson, Bradenton; William E. Shaw, Sarasota, both of Fla.

[73] Assignee: Teleflex Incorporated, Limerick, Pa.

[21] Appl. No.: 919,502

[22] Filed: Oct. 16, 1986

[51] Int. Cl.[4] ..... H01H 1/16

[52] U.S. Cl. ..... 200/277; 200/336; 200/292; 200/308; 200/11 A; 200/11 DA

[58] Field of Search ..... 200/277, 155 A, 292, 200/11 R, 11 A, 11 DA, 240, 243, 295, 308, 336

[56] References Cited

U.S. PATENT DOCUMENTS

| | | | |
|---|---|---|---|
| 2,135,809 | 11/1938 | Fruth | 200/277 |
| 2,498,651 | 2/1950 | Crom | 200/11 R |
| 2,817,722 | 12/1957 | Johnson | 200/277 |
| 2,834,842 | 5/1958 | Le Beau | 200/277 |
| 3,996,440 | 12/1976 | Niconienko | 200/277 |
| 4,443,670 | 4/1984 | Nakamura et al. | 200/292 |

FOREIGN PATENT DOCUMENTS

| | | | |
|---|---|---|---|
| 93408 | 3/1922 | Switzerland | 200/155 A |

*Primary Examiner*—Henry J. Recla
*Assistant Examiner*—Linda J. Sholl
*Attorney, Agent, or Firm*—Reising, Ethington, Barnard, Perry & Milton

[57] ABSTRACT

An electrical rotary switch includes a single support housing (18) for rotation about a base (12). The base (12) is a circuit board which includes an opening (16) through which the housing (18) is secured to the base. A pair of contact pads (14) extend radially away from the opening (16) on the base (12). The housing (18) includes a cavity (34) facing the base (12). A conductive roller (38) is located in the cavity (34) for rolling over the pair of contact pads (14) to establish an electrical connection. The switch is characterized by a fulcrum ridge (40) extending from the housing (18) into the cavity (34) for allowing the roller (38) to rock in case a bump is incurred in the contact pads (14) to ensure an electrical connection.

13 Claims, 3 Drawing Figures

TACHOMETER SWITCH

TECHNICAL FIELD

This invention relates to an electrical contact rotary switch connected to a circuit board to enable multi-positioning between pairs of contact pads.

BACKGROUND ART

Rotary switches have been used to make and break electrical connections between contact pads. The contact pads are either standard pads within the apparatus to which leads are connected or pairs of contact pads separated by a space on a circuit board. Rotary switches use a cylindrical conductive rod which makes an electrical connection between two pads when the rod rolls over the two contact pads. The cylindrical rod is rolled off the contact to break the electrical connection.

One type of such assemblies includes a rotatable base portion with detent means for aligning with contact pads on a circuit board. The detent means are rectangular openings into which cylindrical conductive rods may fall. A top portion is secured to the circuit board and contains tabs extending downwardly and presenting concave undersides. The conductive rods are adjacent the concave undersides and extend radially outwardly. The base portion is rotated which either aligns the detent means with the contact pads on the circuit board to allow the cylindrical conductive rods to fall therein making an electrical connection, or moves the detent means to an unaligned position with respect to the contact pads therefore breaking any electrical connections. An inadequacy of this assembly is that the base portion has a fixed number of contact areas and that the conductive rods are in a fixed positions. The assembly is difficult because there are several pieces. The U.S. Pat. No. 3,996,440 granted Dec. 7, 1976 in the name of Solomon J. Niconienko discloses such a system where a rotatable base portion and an immobile top portion are used to make an electrical connection on a circuit board.

SUMMARY OF THE INVENTION AND ADVANTAGES

The invention is an electrical rotary switch which includes a base having an opening and which supports a pair of electrical contact pads spaced radially from one another relative to the opening. A single housing is supported on the base for rotation about the opening and has a radially extending and partially enclosed cavity facing the base having sides extending toward the base. A conductive roller is disposed in the cavity and extends radially from the opening for rolling about the base guided by the sides to establish an electrical connection between the contact pad. The assembly is characterized by a fulcrum ridge extending into the cavity and engaging the roller between the ends thereof to provide rocking movement of the ends of the roller within the cavity about the fulcrum ridge.

The present invention improves the prior art by using a single housing for ease in assembly and by allowing the conductive roller to be freely positioned at any radial angle without the requirement of a dedicated housing.

BRIEF DESCRIPTION OF THE DRAWINGS

Other advantages of the present invention will be readily appreciated as the same becomes better understood by reference to the following detailed description when considered in connection with the accompanying drawings wherein.

DESCRIPTION OF THE PREFERRED EMBODIMENT

Figure 2:
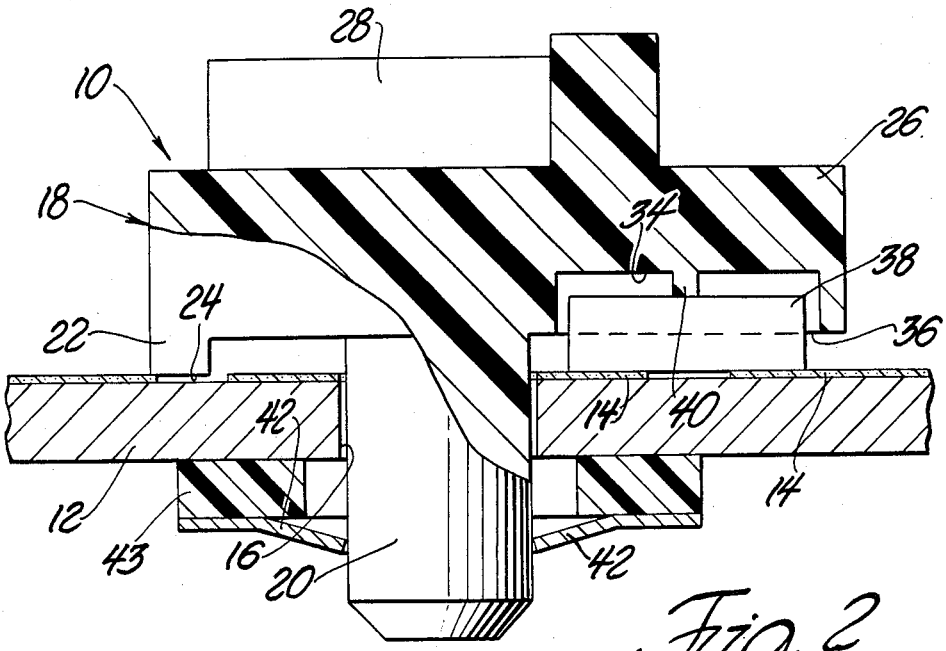
FIG. 2 is a partially broken away side view taken substantially along line 2—2 of FIG. 1.
Figure 1:
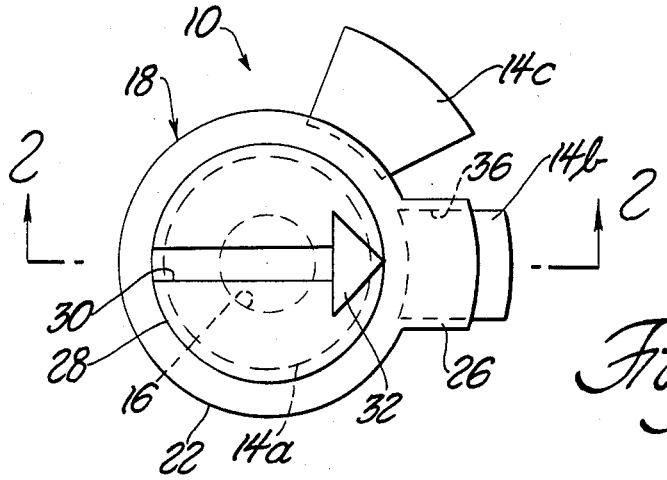
FIG. 1 is a top view of a preferred embodiment of the subject invention.

An electrical rotary switch is generally shown at 10 in FIGS. 1 and 2. The assembly includes a base 12 supporting at least one pair of electrical contact pads 14. The base 12 contains an opening 16 radially aligned with the pair or pairs of contact pads 14. The contact pads 14 are spaced radially from one another relative to an opening 16. A single housing, generally shown at 18, is supported on the base 12 for rotation about the opening 16. The housing 18 includes a cylindrical stem 20 integral with and extending downwardly from the support housing 18 into the opening 16 for securing to the base 12 and for rotating the housing 18 in a plane parallel to the plane of the base 12.

The housing 18 comprises a circular lower portion 22 from which the stem 20 extends. The lower portion 22 is adjacent the base 12 with a narrow separation 24 therebetween for clearance of the lower portion 22 over the contact pads 14 when rotated. The lower portion 22 includes a rectangular portion 26 extending radially from the opening 16 in the plane of the base 12. The housing 18 also comprises an upper portion 28 having a smaller diameter than the lower portion 22. The upper portion 28 is adjacent the lower portion 22 for rotation of the housing 18. A notch 30 extends across the diameter of the upper portion 28. The notch 30 is parallel to the rectangular extension 26 and includes an arrow 32 pointing in the direction of the rectangular extension 26 for indicating angular direction of the contact pads 14 used in an electrical connection. In order to ensure an electrical connection with a pair of contact pads 14, the arrow 32 should point to the contact pad 14 with which an electrical connection is to be made. FIG. 1 shows an electrical connection between the contact pad **14*a* and the contact pad 14*b* by the direction of the arrow 32. As a result, the rectangular portion 26 will partially extend over and align with the contact pad 14** for the desired electrical connection.

The housing 18 includes a radially extending and partially enclosed cavity 34 facing the base 12 which has sides 36 extending towards the base 12. The cavity 34 is contained partially within the rectangular portion 26 and partially within the lower portion 22 of the housing 18. A conductive roller 38 is disposed in the cavity 34 which extends radially from the opening 16. The conductive roller 38 is for used rolling about the base 12 guided by the sides 36 of the cavity 34 which ensure even rolling and proper alignment of the roller 38. The conductive roller 38 establishes an electrical connection between the contact pads 14 when in the aligned position. The cavity 34 is rectangular in shape for uniformly rolling the conductive roller 38 over the contact pads 14.

Figure 3:
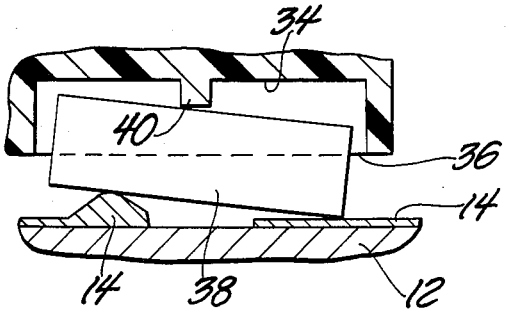
FIG. 3 is a cross-sectional view of the cavity and the conductive rod.

A fulcrum ridge 40 extends from the housing 18 into the cavity 34 and engages the conductive roller 38 in the center of the roller 38 between the ends to provide rocking movement of the ends of the roller 38 about the fulcrum ridge 40. The ridge 40 is shown in FIGS. 1 and 3. FIG. 3 illustrates the rocking motion of the conductive roller 38 when there is a small bump in one of the contact pads 14. The contact pads 14 may be solder points on a circuit board wherein irregularities in the contact pad 14 are frequent. The fulcrum ridge 40 allows the conductive roller 38 to pivot with respect to the fulcrum ridge 40 which will allow for an electrical connection between contact pads 14 independent of the smoothness or uniformity in the contact pads 14. The sides 36 of the cavity 34 hold the roller 38 directly over the contact pads 14 even when irregularities are encountered in the contact pads 14.

As shown in phantom in FIG. 2, one contact pad 14(*a*) may entirely surround the opening 16. A second contact pad 14(*b*) will radially extend from the first contact pad 14(*a*) with a space there between. A third contact pad 14(*c*) is shown, wherein there may be more or less than one pair of contact pads 14(*a*) and 14(*b*). The position of the switch in FIG. 2 indicates a connection between the first 14(*a*) and second contact 14(*b*) pads. If the switch was rotated in the counter-clockwise direction so that the rectangular extension 26 was over the third contact pad 14(*c*), an electrical connection would be made between the first 14(*a*) and third 14(*c*) contact pads thus breaking the connection between the first 14(*a*) and second 14(*b*) contact pads.

The assembly includes a push type fastener 42 to secure the cylindrical stem 20 of the housing 18 to the base 12 through the opening 16 so that the housing 18 rotates with respect to the base 12. The fastener 42 creates a force against the conductive roller 38 against the contact pads 14 to ensure an electrical connection. The assembly includes an elastomer washer 43 having a hole therethrough to receive the stem 20 which reacts between the base 12 and the fastener 42. The washer 43 increases the spring biasing of the roller 38 against the contact pads 14 and eliminates shifting of the roller 38 relative to the contact pads 14 due to vibrations. The fastener 42 is a belleville type washer, of the well-known type, which has a hole with slits extending radially therefrom that define metal pedals extending radially about the stem 20. The pedals have the ability to be bent by a predetermined force while resisting the force. Thus, the fastener 42 acts as a spring to retain the conductive roller 38 upon the contact pads 14. The fastener 42 is usually made of a thin pliable sheet metal.

The conductive roller 38 is made of a conductive material such as metal. The housing 18 is made of a rigid nonconductive material such as plastic. The washer 43 is elastomeric, such as neoprene.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. An electrical rotary switch assembly, said assembly comprising; a base (12) having an opening (16) and supporting a pair of electrical contact pads (14) spaced radially from one another relative to said opening (16), a single housing (18) supported on said base (12) for rotation about said opening (16) and having a radially extending and partially enclosed cavity (34) facing said base (12) and having sides (36) extending toward said base (12), a conductive roller (38) disposed in said cavity (34) and extending radially from said opening (16) for rolling about said base (12) while guided by said sides (36) and for establishing an electrical connection between said contact pads (14), a fulcrum ridge (40) extending into said cavity (34) and engaging said roller (38) between the ends thereof to provide rocking movement of the ends of said roller (38) within said cavity (34) about said fulcrum ridge (40), a cylindrical stem (20) integral with and extending downwardly from said housing (18) and into said opening (16) for securing said housing (18) to said base (12) for rotation of said housing (18) in a plane parallel to the plane of said base (12), and a biasing means (42) reacting between said cylindrical stem (20) and said base (12) for securing said stem (20) in said opening (16) for rotating said housing (18) with respect to said base (12) and for creating a force biasing said conductive roller (38) against said contact pads (14) and said base (12).

2. An electrical rotary switch assembly, said assembly comprising; a base (12) having an opening (16) and supporting a pair of electrical contact pads (14) spaced radially from one another relative to said opening (16), a single housing (18) supported on said base (12) for rotation about said opening (16) and having a radially extending and partially enclosed cavity (34) facing said base (12) and having sides (36) extending toward said base (12), a conductive roller (38) disposed in said cavity (34) and extending radially from said opening (16) for rolling about said base (12) while guided by said sides (36) and for establishing an electrical connection between said contact pads (14), a fulcrum ridge (40) extending into said cavity (34) and engaging said roller (38) between the ends thereof to provide rocking movement of the ends of said roller (38) within said cavity (34) about said fulcrum ridge (40), and a cylindrical stem (20) integral with and extending downwardly from said housing (18) and into said opening (16) for securing said housing (18) to said base (12) for rotation of said housing (18) in a plane parallel to the plane of said base (12).

3. An assembly as set forth in claim 2 wherein said cavity (34) is rectangular in shape for uniformly rolling said conductive roller (38) over said contact pads (14).

4. An assembly as set forth in claim 3 wherein said assembly includes a biasing fastener means (42) reacting between said cylindrical stem (20) and said base (12) for securing said stem (20) in said opening (16) for rotating said housing (18) with respect to said base (12) and for creating a force biasing said conductive roller (38) against said contact pads (14).

5. An assembly as set forth in claim 1 wherein said assembly includes an elastomer washer (43) reacting between said base (12) and said biasing fastener means (42) having a hole therethrough to receive said stem (20) for increasing biasing force of said conductive roller (38) against said contact pads (14) and for eliminating shifting of said conductive roller (38) relative to said contact pads (14) due to vibrations.

6. An assembly as set forth in claim 5 wherein said housing (18) comprises a circular lower portion (22) with a rectangular extension (26) extending radially from said opening (16) in the plane of said base (12).

7. An assembly as set forth in claim 6 wherein said rectangular extension (26) contains a portion of said cavity (34) surrounding said conductive roller (38) for extension of said conductive roller (38) away from said lower portion (22) of said housing (18).

8. An assembly as set forth in claim 7 wherein said housing (18) comprises an upper portion (28) of a smaller diameter than said lower portion (22) and is adjacent said lower portion (22) for rotation of said housing (18).

9. An assembly as set forth in claim 8 wherein said upper portion (28) contains a notch (30) extending across the diameter of said upper portion (28), said notch (30) being parallel to said rectangular extension (26), said upper portion (28) including an arrow (32) pointing in the direction of said rectangular extension (26) for indicating angular direction of said conductive roller (38).

10. An assembly as set forth in claim 9 wherein said conductive roller (38) is made of metal.

11. An assembly as set forth in claim 10 wherein said housing (18) is made of a rigid and nonconductive plastic material.

12. An assembly as set forth in claim 11 wherein said fastener (42) is a bellville type washer having a hole with slits extending radially therefrom to define pedals extending radially about said stem, said pedals being bendable in response to a predetermined force while resisting said force.

13. An assembly as set forth in claim 12 wherein said fastener (42) is made of a thin pliable metal sheet.

* * * * *